US005444956A

United States Patent [19]

Searer et al.

[11] Patent Number: 5,444,956

[45] Date of Patent: Aug. 29, 1995

[54] TRIM MOLDING WITH REMOVABLE INSERT

[75] Inventors: Floyd A. Searer, Elkhart; Charles W. Tack, Warsaw, both of Ind.

[73] Assignee: Fas, Inc., Elkhart, Ind.

[21] Appl. No.: 222,272

[22] Filed: Apr. 4, 1994

[51] Int. Cl.[6] ..... E04C 1/00

[52] U.S. Cl. ..... 52/312; 52/716.1

[58] Field of Search ..... 52/311.1, 311.2, 312, 52/716.8, 717.04

[56] References Cited

U.S. PATENT DOCUMENTS

| | | | |
|---|---|---|---|
| 1,933,691 | 11/1933 | Young | 52/311.1 |
| 2,316,035 | 11/1940 | Westrope . | |
| 3,775,926 | 12/1973 | Brown et al. . | |
| 3,803,781 | 4/1974 | Struben . | |
| 4,274,237 | 6/1981 | Hagstrom . | |
| 5,193,322 | 3/1993 | Wood . | |

FOREIGN PATENT DOCUMENTS 259332 10/1926 United Kingdom .

*Primary Examiner*—Carl D. Friedman
*Assistant Examiner*—Yvonne Horton-Richardson
*Attorney, Agent, or Firm*—Watson Cole Grindle & Watson

[57] ABSTRACT

A mold trim member is formed of an elongated body member including spaced elongated channels extending along the longitudinal axis thereof; a backing member attached to the spaced channels so that the surface of the backing member is exposed between the channel members; a removable first insert member including cut-out portions and being inserted between the channels with the surface viewable between the cut-out portions and a removable second insert member inserted between the removable first insert member and the surface of the backing member with the surface of the second removable member viewable between the cut-out portions of the removable first insert member. The surface pattern of the second removable insert member may be changed either by inserting another second removable insert member having a different surface and/or changing the first removable insert member with another having different cut-out portions.

7 Claims, 2 Drawing Sheets

TRIM MOLDING WITH REMOVABLE INSERT

BACKGROUND OF THE INVENTION

1. Field of the Invention

This invention relates to trim molding for housing, exterior as well as interior applications, and recreational vehicle (RV) applications, and more particularly to such trim molding in which a base molding member is provided with tracks for retaining removable inserts with a first insert having fully cut patterns and a second insert providing a background visible through the cut portions of the first insert, thereby enabling a plurality of different cut portions and background combinations to be simply and inexpensively to be obtained.

2. Related Art

There are a number of prior art products that are related to the subject invention as exemplified by the following patents.

U.S. Pat. No. 5,193,322 entitled "Molding Assembly" discloses, inter alia, an elongated base molding, a trim recess, a trim molding fitted within the trim recess and retention inserts in the base molding for holding the trim molding in place. The present invention at least differs from the structure of this reference in that it does not require any structure akin to retention inserts for retaining the inserts in the base mold.

U.S. Pat. No. 4,274,237 entitled "Holder for a Decorative Trim Strip" including parallely disposed first and second ledges forming a channel in a trim strip holder and including elongated first and second recesses for retaining an elongated trim strip. In addition to the detailed structure of the channel and the ledges for retaining the trim strip the disclosure of this reference fails to disclose or suggest the additional insert of the present invention.

U.S. Pat. No. 3,803,781 discloses only a decorative insert strip which is retained in a simple U-shaped channel supported from the underside of a mobile home.

U.S. Pat. No. 2,316,035 discloses an elongated base member with a longitudinal recess formed in the exposed surface thereof and which recess receives a longitudinal strip of ornamental material.

U.S. Pat. No. 3,775,926 relates to a chair rail assembly including an elongated rigid supporting member with a pair of bumper strip receiving channels which retain individual bumper strips.

SUMMARY OF THE INVENTION

It is believed apparent from a consideration of these references that none of them, taken either singly or in combination, disclose or suggest the features of the present invention, and in particular the second insert which affords a variable background capability to cut-through molding retained in a channel formed within a base mold member.

A primary feature of the present invention is to provide a second removable decorative strip to be inserted behind or in back of a first removable decorative strip having cut-through portions in a base mold member, whereby portions of the first insert are visually observable.

This relationship between the two removable strip members enables the decorative pattern and the background to be easily changed and affords a number of different readily exchangeable combinations of the cut-through patterns and the visible background to be altered.

The trim molding of the present invention may be used as interior or exterior trim for houses and/or RVs.

The trim molding of the present invention is inexpensive and simple to construct and assembly at the building site whether in a factory or at the place of construction in the field.

BRIEF DESCRIPTION OF THE DRAWINGS

The above objects, features and advantages of the invention are readily discerned from a consideration of the following description of a preferred embodiment of the best mode of carrying out the invention when taken in conjunction with the following drawings, wherein.

DETAILED DESCRIPTION

Figure 1:
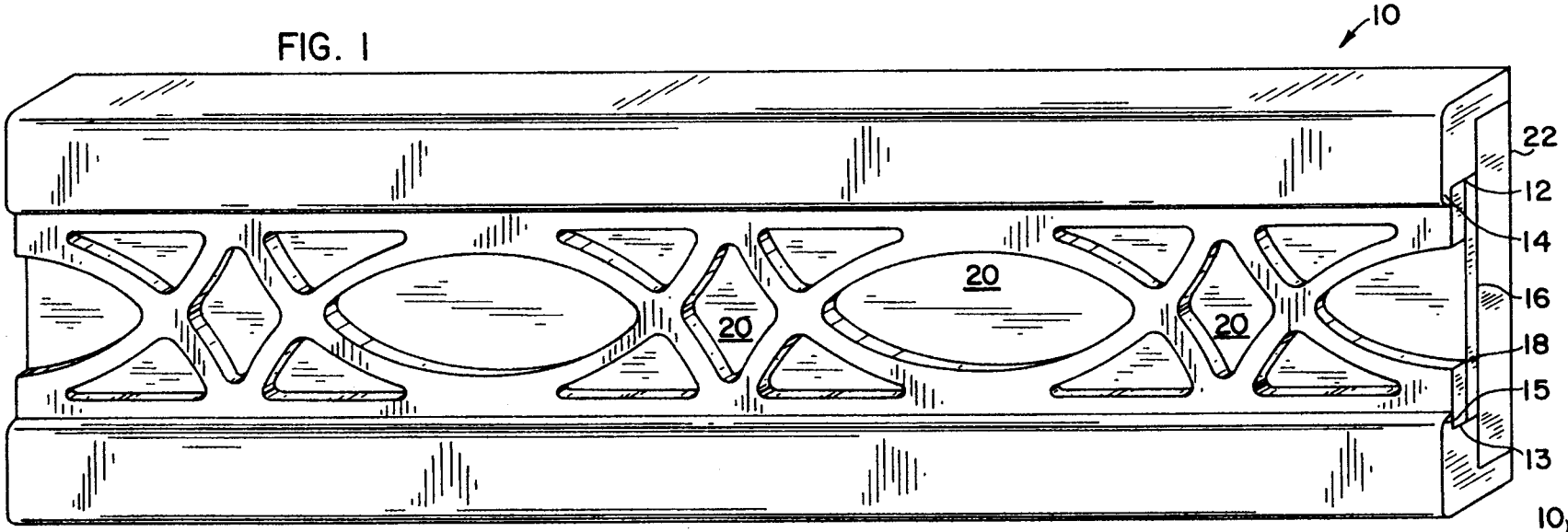
FIG. 1 is a perspective view of of the trim molding member according to a preferred embodiment of the invention.
Figure 2:
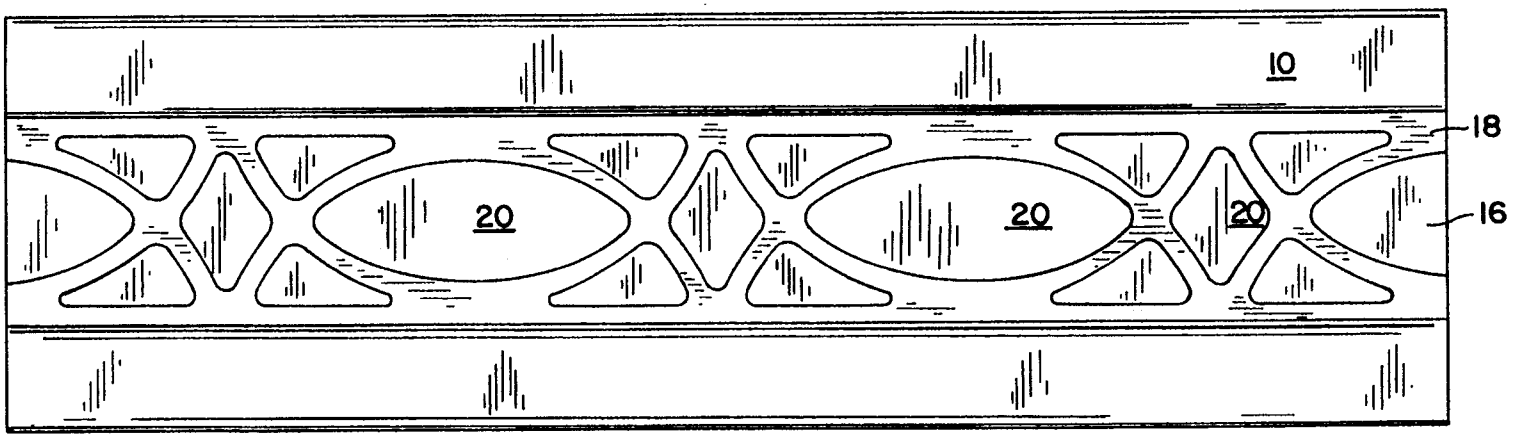
FIG. 2 is a front view of the trim mold member of FIG. 1.
Figure 3:
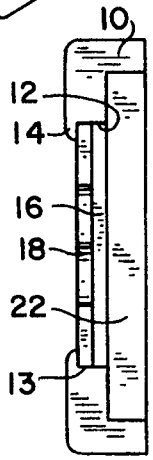
FIG. 3 is a side view of the mold trim member of FIGS. 1 and 2 and illustrating the relationship of the first and second insert members.

In the first embodiment of the invention shown in FIGS. 13, elongated base mold member 10, made preferably of two pieces of wood or wood composition, includes channels 12, 13 and respective lips 14, 15 extending the length of the base mold member for retaining a first insert member 16 with a planar surface and second insert member 18 having patterned cut-out portions. Thus, it is apparent that the surface of the first insert member 16 is visible through the cut-out portions 20 of the second insert member 18. Backing member 22 completes the assembly of the trim mold member 10.

Because the first and second insert members 16 and 18 are removably inserted within channels 12 and 13 it is possible to simply change the cut-out portions and the background visible therethrough by merely removing one set of inserts and replacing them with another set of inserts wherein the first insert has a different cut-out portion and the second insert has a different surface pattern or color.

Figure 4:
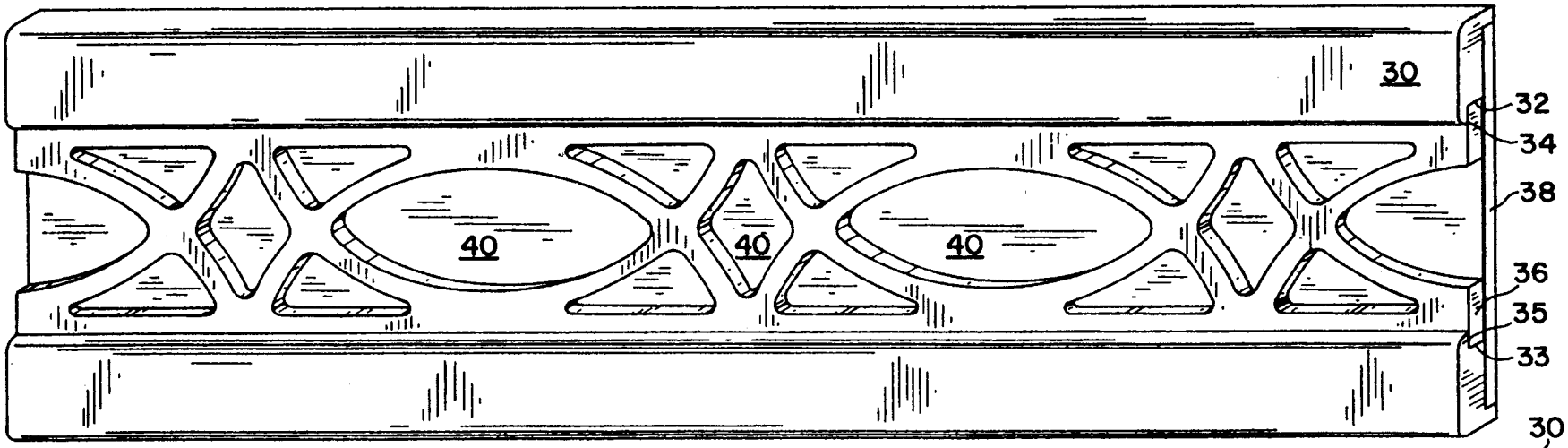
FIG. 4 is a perspective view of the the trim molding according to a modified embodiment of the present invention.
Figure 5:
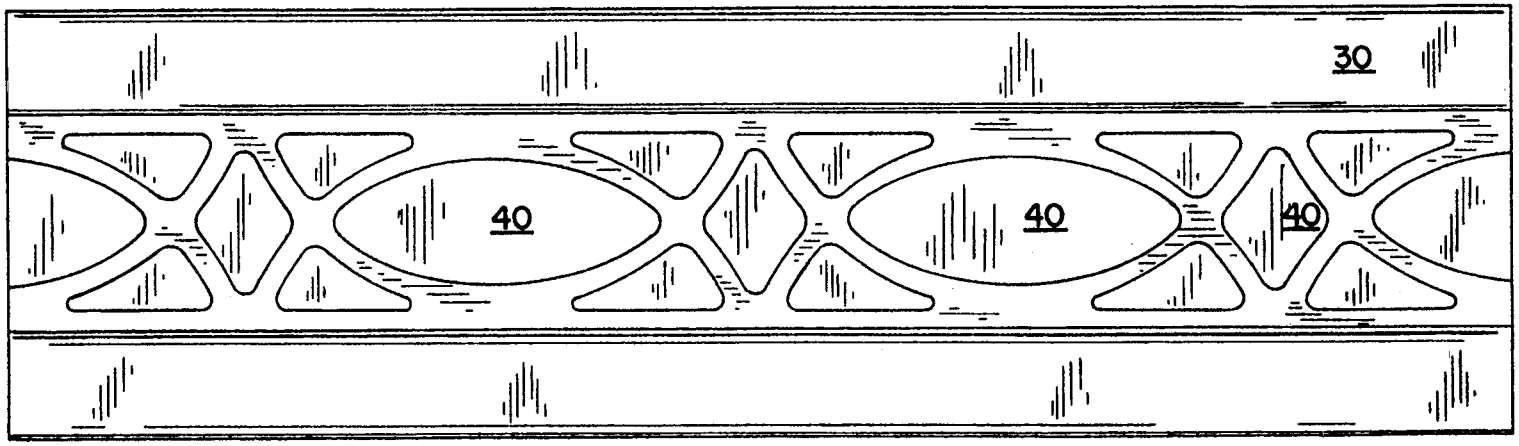
FIG. 5 is a front view of the trim mold member of FIG. 4.
Figure 6:
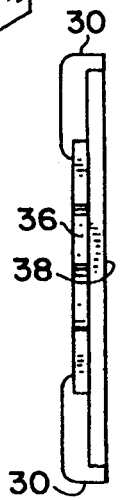
FIG. 6 is a side view of the mold trim member of FIGS. 4 and 5 and illustrating the relationship of the first and second insert members.

A modified embodiment of the invention is illustrated in FIGS. 4–6, which is similar to that of the first embodiment except that there is only one insert member inserted in the base mold member. Specifically, elongated base mold member 30, made preferably of two pieces of wood or wood composition, includes channels 32, 33 and respective lips 34, 35 extending the length of the base mold member for retaining a single insert member 36 with patterned cut-out portions 40. Backing member 38 completes the assembly of the trim mold member 30. Thus, it is apparent that the surface of the backing member 38 is visible through the cut-out portions 40 of the single insert member 36.

The removable single insert member may be easily removed and another insert member with a different cut-out pattern inserted in channels 32, 33 to vary the pattern observable from the front of trim mold member 30. Also, the surface of the backing member viewable through cut-out portions 40 may be altered to provide variation in that aspect of the observable design.

It is readily apparent that the trim mold member of the invention may be made of materials other than wood, such as plastic or metal. The means of forming the channels in the trim mold member are known to those skilled in the art so that further description of such cut-out portions is not necessary to enable the invention to be practiced. The respective channel members and the backing member may be fastened by glue, nails or screws.

The above description of preferred embodiments of the invention is given for the purposes of presenting an enabling description of the best mode of carrying out the invention and is not to be construed as limiting the invention to the precise construction set forth herein. Those of ordinary skill in the art of carpentry will recognize that various modifications and alterations of the invention described herein may be made without departing from the spirit of the invention. The scope of the invention is to be limited only by the equivalents of the various elements set forth in the appended claims.

What is claimed is:

1. A mold trim member, comprising:

an elongated body member including spaced elongated channels extending along the longitudinal axis thereof;

a backing member attached to said spaced channels so that the surface of the backing member is exposed between said channel members;

a removable first insert member including cut-out portions and being inserted between said channels with said surface viewable between said cut-out portions; and a removable second insert member inserted between said removable first insert member and the surface of said backing member, with the surface of said second removable member viewable between the cut-out portions of said removable first insert member.

2. The mold trim member according to claim 1, wherein said elongated body member, said backing member and both said first and second removable insert members are made of wood.

3. The mold trim member according to claim 1, wherein said elongated body member, said backing member and both said removable first and second insert are made of plastic.

4. The mold trim member according to claim 1, wherein said elongated body member, said backing member and both said removable first and second insert members are made of metal.

5. The mold trim member according to claim 1, wherein the surface of said second removable insert member viewable through the cut-out portions of said first removable member is changeable by replacing the first removable insert member with another first removable member having a different pattern of cut-out portions.

6. The mold trim member according to claim 1, wherein the surface of said second removable insert member viewable through the cut-out portions of said first removable member is changeable by replacing the second movable insert member with another second movable insert member having a different surface design.

7. The mold trim member according to claim wherein the surface of said second removable insert member viewable through the cut-out portions of said first removable member is changeable by replacing the first removable insert member with another first removable insert member having different cut-out portions.

* * * * *